United States Patent [19]

Stokes

[11] Patent Number: 4,949,843

[45] Date of Patent: Aug. 21, 1990

[54] ONE-PIECE MULTI-POCKETED STORAGE DEVICE

[76] Inventor: William T. Stokes, 1125 Robin Way, Sunnyvale, Calif. 94087

[21] Appl. No.: 401,185

[22] Filed: Aug. 31, 1989

[51] Int. Cl.[5] ..... B65D 30/04; B65D 30/22; B65D 30/08

[52] U.S. Cl. ..... 206/305; 206/454; 383/38

[58] Field of Search ..... 383/38, 39, 40; 206/454, 456, 305, 320, 454; 40/159

[56] References Cited

U.S. PATENT DOCUMENTS

| | | | |
|---|---|---|---|
| 2,359,372 | 10/1944 | Leader | 383/39 |
| 2,532,517 | 12/1950 | Schwertzman et al. | 383/39 |
| 2,780,260 | 2/1957 | Watson | 383/39 |
| 2,832,389 | 4/1958 | Smith | 383/39 |
| 3,187,903 | 6/1965 | Oltz | 383/39 |
| 3,207,421 | 9/1965 | Hunger et al. | 383/39 |
| 3,331,513 | 7/1967 | Cappelli | 383/39 |
| 3,749,237 | 7/1973 | Dorton | 383/39 |
| 3,967,666 | 7/1976 | Farrar | 383/39 |
| 4,164,968 | 8/1979 | Esposito, Jr. et al. | 383/39 |

*Primary Examiner*—Paul T. Sewell
*Assistant Examiner*—Jacob K. Ackun, Jr.
*Attorney, Agent, or Firm*—Thomas M. Freiburger

[57] ABSTRACT

An item storage device with a plurality of open-topped storage pockets in a matrix of rows and columns is formed of a single sheet of material, preferably of woven fabric. The single sheet is lapped over in a series of horizontal fold lines, forming alternating three-ply areas and single-ply areas. An overlap opening at the top of each three-ply area or row forms the pockets of that row. Left and right ends of the folded sheet are folded on a vertical fold line to form a small hem which is stitched on a vertical line to form closed margins at left and right. Horizontal stitch lines are made to hold at least two of the three plies together along horizontal lines which define the bottoms of the pockets. Additional vertical stitch lines are made to define and separate the pockets laterally. In preferred embodiments a series of circular grommets are secured through a doubled-over fabric hem along the top edge of the carrying device, to enable suspending the device vertically. A series of calculators, for example, may be carried in the pockets, as for classroom use.

24 Claims, 2 Drawing Sheets

ONE-PIECE MULTI-POCKETED STORAGE DEVICE

BACKGROUND OF THE INVENTION

The invention relates to a storage, carrying and dispensing apparatus, and more particularly the invention is concerned with a storage and carrying device having a plurality of pockets for receiving, storing and dispensing a number of items which may be similar in size and shape.

In one preferred embodiment the invention is directed at storing a plurality of hand-held calculators such as for classroom use, in an apron-like device with storage pockets from which the calculators extend. The carrying device can itself be suspended in a generally vertical plane for dispensing and receiving the calculators An important aspect of the invention is a system of construction by which such an item storage device is produced Storage and dispensing devices in generally apron-like configuration, with series of pockets, have been previously known for several purposes Shoe holders or "shoe bags", for example, have had rows and columns of pockets sized to receive shoes, such as for placement on the inside of a closet door. Calculator holders have also been known, usually formed of plastic strips secured by adhesion or heat-sealing to a sheet of plastic material.

A more typical way of storing and carrying calculators for classroom use has been to place them in plastic binders similar to instructional cassette tape holders. For 30 calculators, three such binders were generally required.

None of the previously known article holders of this general type has been as economical in construction and as efficiently formed as the storage and dispensing device of the present invention described below.

SUMMARY OF THE INVENTION

In accordance with the present invention, a hangable, apron-like storage device has a series of open-topped pockets and is configured so as to store, display and conveniently present a number of similar articles, such as calculators for classroom use. In a preferred embodiment, the storage device is formed of a single sheet of material, folded and stitched along horizontal and vertical lines of stitching so as to produce the pockets in rows and columns without the need for the securing of separate cuts of material.

The pockets in the one-piece integral storage device are formed by making a series of Z-shaped folds along horizontal fold lines, such that the material is in three plies along horizontal bands or strips in the device, alternating with single-ply bands of material. In a preferred embodiment, horizontal stitching lines secure at least the back and middle plies of material in these three-ply areas at the bottom of each row of pockets, although these can be eliminated in another embodiment.

Vertical stitching lines define the left and right edges of each pocket, with the pockets preferably arranged in columns as well as in rows (although the pockets could be staggered). Additional vertical stitching can be added to form a folded-over hem at left and right. Similar hems can be formed horizontally at the top and bottom of the finished device.

The storage apparatus of the invention is intended generally for two purposes: as a storage and carrying device with the articles retained in the pockets and the entire device folded along the single-ply bands to form a compact configuration (it may be folded accordion style, left to right or top to bottom); and for displaying and dispensing the articles by hanging the device in a vertical, generally planar arrangement. For this latter purpose, there preferably are provided at least two holes in the top horizontal margin of the device, reinforced by grommets so that the device can be suspended from hooks.

It is therefore among the objects of the invention to provide an improved sheet-like carrying and dispensing device with pockets for articles such as hand-held student calculators. Another object is to construct the carrying device of a single sheet of material, folded and stitched in such a way as to form a series of open-topped pockets for holding the articles. These and other objects, advantages and features of the invention will be apparent from the following description of a preferred embodiment, considered along with the accompanying drawings.

DESCRIPTION OF PREFERRED EMBODIMENTS

Figure 1:
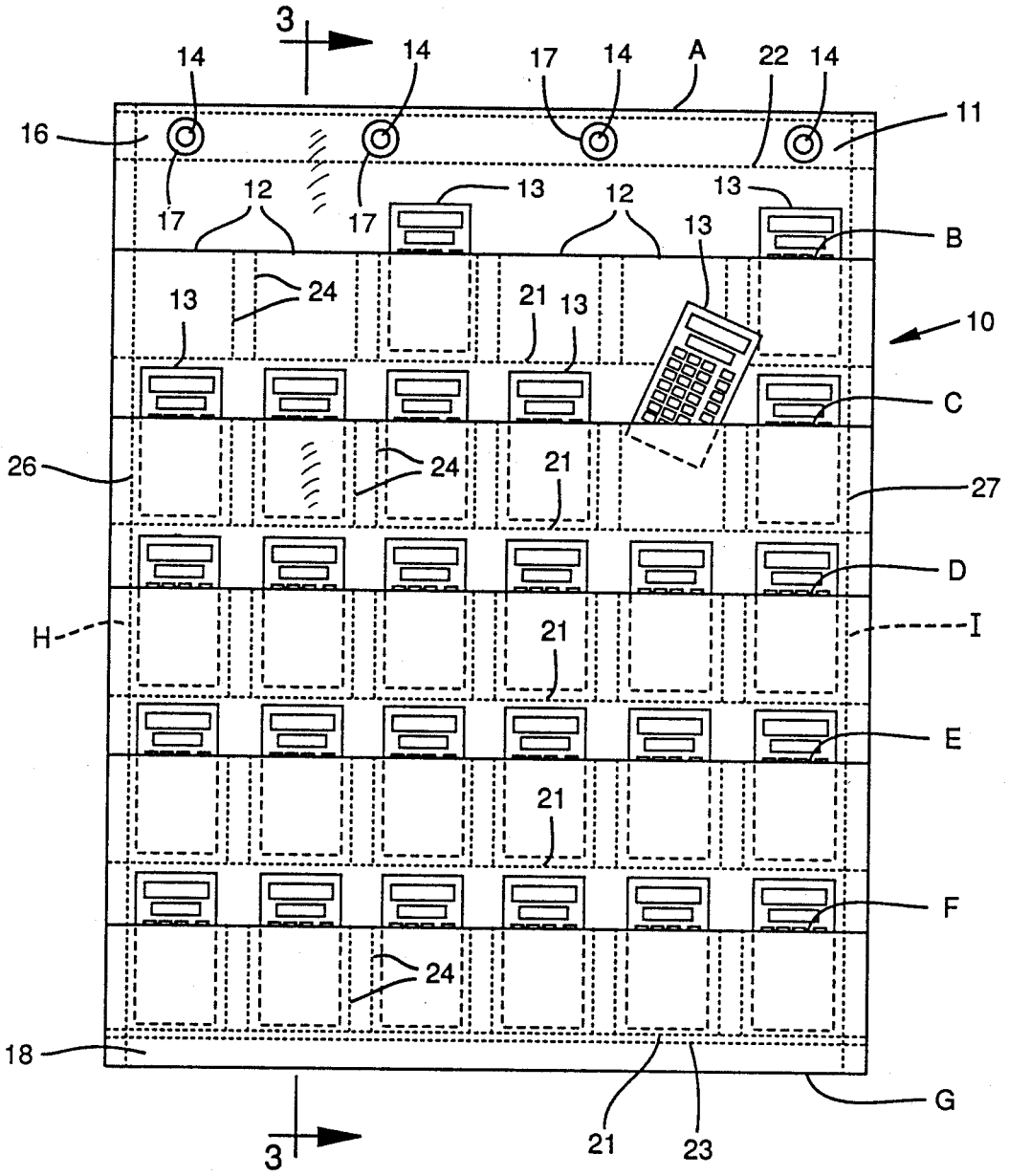
FIG. 1 is a plan view of a storage, carrying and dispensing device in accordance with the principles of the invention, shown with calculators held in pockets of the device.

In the drawings, FIG. 1 shows a storage, carrying and dispensing device 10 in an apron-like or generally "shoe bag" type configuration. The device 10 in a preferred embodiment comprises a single sheet of material 11, preferably a fabric material, folded and stitched in a way described herein so as to produce a plurality of open-topped pockets 12, which may be in rows and columns as illustrated.

The foldable carrying device 10 may have uniformly sized pockets 12 for receiving a number of similarly sized items such as a series of calculators 13 for classroom use. Preferably the pockets 12 receive the calculators (or other articles) such that a top portion of the calculator 13 is exposed to view and for grasping and removing when the calculators are to be used.

As also illustrated in FIG. 1, there preferably are a series of holes 14 provided along a top hem or margin strip 16 of the carrying device, reinforced by grommets 17 as illustrated. These holes and grommets, of which there are at least two and may be four, as shown, enable the device 10 to be suspended from hooks or nail heads on a wall, for example, so that the device hangs in generally planar vertical configuration. This makes the carried articles 13 accessible for removal from and replacement into the pockets 12.

If desired for use in a classroom, for example, the pockets 12 may bear a series of numbers (not shown) to identify the appropriate pocket for use by each student in the class.

The carrying device 10, as mentioned above, preferably is formed by folding the single, integral sheet of material 11 at a series of fold lines and by stitching or otherwise attaching layers of material along a series of stitching lines. Principal horizontal fold lines are shown in FIG. 1 at A, B, C, D, E, F and G. Principal vertical fold lines are shown in FIG. 1 at H and I. Additional horizontal fold lines are at the rear of the device 10 and are not visible in FIG. 1, but are shown in FIGS. 2 and 3.

Figure 2:
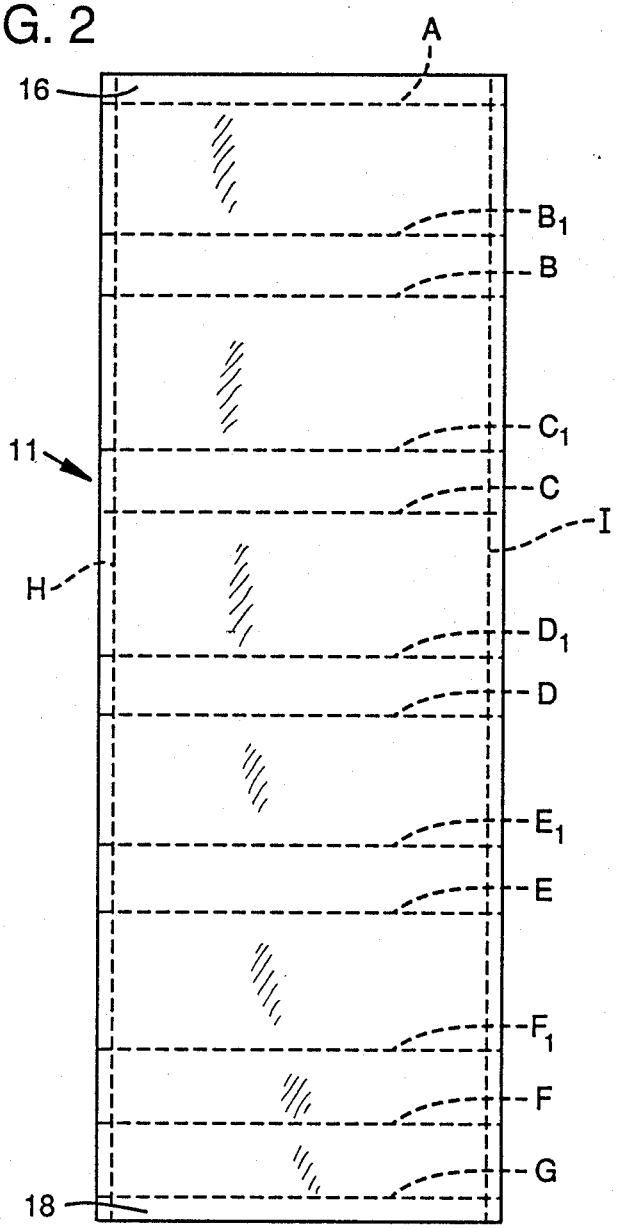
FIG. 2 is a plan view showing the device of FIG. 1 prior to stitching, in developed configuration, and indicating horizontal fold lines which will be made to form the completed device.
Figure 3:
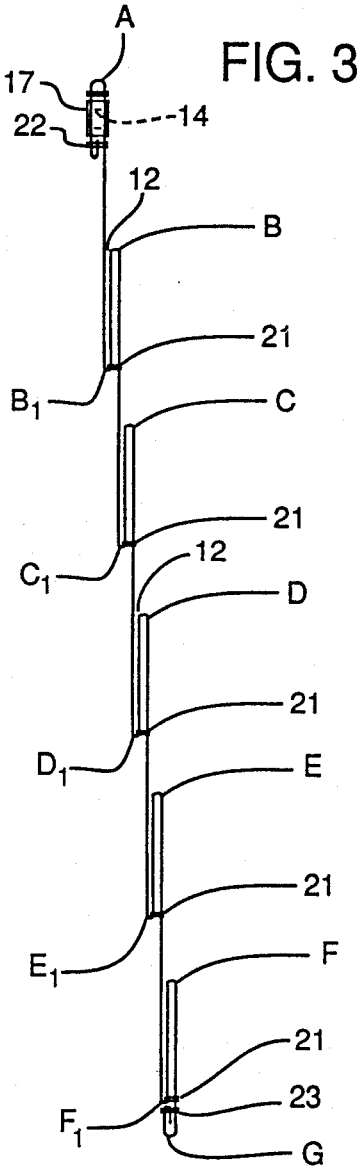
FIG. 3 is a sectional view in elevation as seen along the line 3—3 in FIG. 1, indicating folds made in the sheet of material shown in FIG. 2 and stitching for retaining the folds and forming the pockets.

FIGS. 2 and 3 further indicate the construction of and the method for production of the carrying device 10. In FIG. 2, the horizontal fold lines A through G are illustrated on a developed sheet of material 11 prior to any folding. The top and bottom horizontal fold lines A and G, which form the top margin area or hem 16 and a bottom margin area or hem 18 (see also FIG. 1), form the extreme top and bottom edges of the finished device. The fold lines B, C, D, E and F are those which become the top edges of the pockets 12. Above each of the pocket edge fold lines B through F are additional horizontal fold lines $B_1$, $C_1$, $D_1$, $E_1$ and $F_1$, which become rear folds forming the bottoms of the pockets in the finished device. At each pair of horizontal fold lines B, $B_1$, C, $C_1$, etc., the material 11 is folded into a Z configuration wherein three plies or layers of material result. This is better seen in FIG. 3, showing the folded and stitched device in cross-sectional profile and indicating all of the horizontal fold lines shown in FIG. 2.

Figure 4:
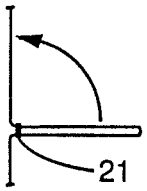
FIG. 4 is a detail view in sectional elevation, showing one step in construction of the device.

As can be seen particularly from FIGS. 1 and 3, once these folding steps have been accomplished, the pockets are formed between the back layer and the middle layer of the three layers in each pocket strip. Stitching is preferably made to retain the device thus folded along the horizontal fold lines, as also indicated in FIG. 3. It is important that the stitching be accomplished along horizontal lines of stitching 21 at the bottom of each row of pockets 12. The stitching 21 can penetrate all three layers, but it is effective if it passes through only the front and middle layers of material. If this preferred stitching is used, through only the front and middle layers, it is preferably accomplished before the folded-together front and middle layers are fully brought up to the vertical position, as indicated in the partial view of FIG. 4.

It should be understood that in another embodiment the horizontal pocket stitching 21 can be eliminated, with vertical stitching lines between pockets (described below) relied upon to hold the horizontal folds in the desired positions.

As also shown in FIG. 3, the fabric material preferably is tucked under in a hem at each terminal edge so as not to expose any raw edge of the material, particularly when the material is subject to fraying, such as with denim (one preferred material for the device). At horizontal stitching lines 22 and 23, short fabric ends are folded and tucked under before the stitch is made as shown in FIG. 3.

The pockets are defined, separated and retained in the desired configuration by vertical lines of stitching 24, best seen in FIG. 1. These lines of stitching 24 preferably penetrate all three layers or plies of material in the pocket strips. There may optionally be more than one line of stitching 24 between each pair of adjacent pockets 12 — two such lines of stitching 24 are shown between pockets in FIG. 1, with spacing between lines. This establishes a spacing between columns of pockets, adequate to enable folding of the carrier with calculators in the pockets, about vertical fold lines between the pockets.

As shown in FIGS. 1 and 2, the construction of the storage and carrying device 10 includes two principal vertical fold lines H and I. These two folds, which become the extreme left and right edges of the finished device, and may be made after all horizontal folds are made and preferably after all other stitching has been accomplished. This manner of construction provides for a neat and relatively uniform edge at right and left. As in the margins 16 and 18 at the top and bottom of the finished device, these folds and the final lines of stitching 26 and 27 preferably involve the tucking under of a small hem of material at the back of the device (not shown), to prevent exposure of material edges.

Figure 5:
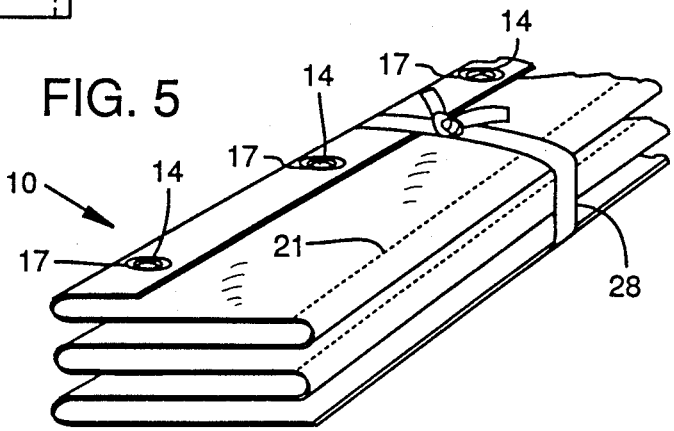
FIG. 5 is a perspective view showing the device as folded in one folding configuration, for storage and carrying of articles.

FIG. 5 is a schematic perspective view showing the carrying and storage device 10 folded for carrying, and containing a plurality of articles such as calculators. With the calculators stored in the pockets, the carrying device 10 may be folded to a relatively compact configuration. The device is shown folded accordion style in FIG. 5, about horizontal fold lines. It can also be folded about vertical fold lines, as discussed above. The folded package may be bound together in this configuration, as by a string or cord 28 indicated in FIG. 5.

It should be understood that the pockets 12, although shown similar in size, could be of differing widths and could also vary in depth from row to row. Also, the pockets need not be lined up in regular columns but could be staggered.

Further, the term "stitching" as used herein and in the claims is intended in a broad sense, to mean stitching with thread, riveting, gluing (with certain materials), heat sealing (with certain materials) or other bonding techniques suitable for effecting lines of attachment in the particular material used.

The configuration of the device can also vary, depending on how it is to be suspended. For example, it may be worn as an apron if desired, with appropriate straps and shape to serve as an apron, and with pockets for any items suitable to a particular situation (such as for a carpenter or other tradesman).

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A multi-pocket carrying device for storing and dispensing a series of items in pockets and for hanging vertically in generally planar form to enable storage and retrieval of the items, comprising, a single, integral sheet of flexible fabric material, the material capable of being folded and of being stitched, a series of folds in the single sheet of material, along spaced parallel horizontal fold lines, defining three-ply overlapped areas of material alternating with single-ply areas of material, and with a fold line exposed at a front surface of the device at the top of each of said three-ply areas, there being a series of the horizontally extending three-ply areas spaced vertically along the height of the device, and a series of vertical lines of stitching, parallel and spaced apart in each three-ply area so as to define and separate a plurality of pockets along each said three-ply area, the pockets being formed between the center ply and the back ply of material, and the pockets being spaced apart and non-overlapping vertically.

2. The device of claim 1, further including suspending means on a portion of the material the carrying device for enabling hanging of the device generally vertically for said storage and retrieval of items.

3. The device of claim 1, further including a top fold line forming a double-ply hem of material extending horizontally at the top of the device, with at least one horizontal line of stitching securing the two plies together.

4. The device of claim 3, further including at least two openings in the two-ply margin at the top of the device, with reinforcing grommets at the openings, serving as a means for suspending the carrying device.

5. The device of claim 1, further including, at each of left and right edges of the device, a vertical fold line wherein all of the alternating three-ply and single-ply material areas are overlapped to form a vertical hem at the left and right edges, with a vertical line of stitching securing each folded vertical hem.

6. The device of claim 1, wherein the vertical lines of stitching between adjacent side-by-side pockets include a plurality of parallel vertical stitch lines.

7. The device of claim 1, wherein the fabric material comprises denim.

8. The device of claim 1, in combination with a series of hand-held calculators, the pockets being sized to receive the calculators, with the top edges of the calculators extending upward from the pockets, and the pockets being spaced apart sufficiently that the calculators do not overlap vertically.

9. The device of claim 8, further including a top fold line forming a double-ply hem of material extending horizontally at the top of the device, with at least one horizontal line of stitching securing the two plies together and at least two openings in the double-ply margin, with reinforcing grommets at the openings, whereby the device may be folded with a calculator in each pocket for storage, and whereby the device may be supported vertically by suspension by said grommets so as to hang the carrying device generally vertically to present the calculators for retrieval.

10. The device of claim 1, further including a series of horizontal lines of stitching, one along a bottom line of each of said three-ply areas, and each horizontal line of stitching connecting at least the front ply and the center ply of material in said three-ply area.

11. A method of constructing a multi-pocket carrying device comprising the steps of:

folding a series of folds in a single, integral sheet of flexible fabric material, along spaced parallel horizontal fold lines, defining three-ply overlapping areas of material alternating with single-ply areas of material, such that a fold line is exposed at a front surface of the device at the top of each of said three-ply areas, and such that there are a series of said three-ply areas spaced vertically along the height of the device, and stitching a series of vertical lines of stitches, parallel and spaced apart in each three-ply area so as to define and separate a plurality of pockets along each said three-ply area, such that the pockets are formed between the center ply and the back ply of material, and with the pockets being spaced apart vertically and non-overlapping.

12. The method of claim 11, further including providing suspending means on the carrying device, on a portion of said integral sheet, such that the device can be hung generally vertically for storage and retrieval of items.

13. The method of claim 11, wherein the flexible fabric material comprises denim.

14. The method of claim 11, wherein the folds are made and the stitching is performed so as to form pockets sized to receive a series of hand-held calculators.

15. The method of claim 11, further including folding the sheet of material along a top fold line to form a double-ply margin or hem of material extending horizontally at the top of the device, and stitching a horizontal line of stitches to secure the two plies together.

16. The method of claim 15, further including making at least two openings in the two-ply hem at the top of the device and reinforcing the openings with grommets to serve as a suspending means for the device.

17. The method of claim 11, wherein the vertical lines of stitching between adjacent side-by-side pockets include a plurality of parallel vertical stitch lines.

18. The method of claim 17, further including placing a calculator in substantially each pocket for storage, and supporting the device generally vertically with the calculators in the pockets to present the calculators for retrieval.

19. The method of claim 11, further including stitching a series of horizontal lines of stitches, one along a bottom line of each said three-ply areas such that each horizontal line of stitching connects at least the front ply and the center ply of material in said three-ply area.

20. In combination with a series of hand-held calculators, a multi-pocket carrying device for storing and dispensing the calculators in pockets and for hanging the carrying device vertically in generally planar form to enable storage and retrieval of the calculators, comprising, a single, integral sheet of flexible material, the material capable of being folded and of being stitched, a series of fold in the single sheet of material, along spaced parallel horizontal fold lines, defining three-ply overlapped areas of material alternating with single-ply areas of material, and with a fold line exposed at a front surface of the device at the top of each of said three-ply areas, there being a series of the horizontally extending three-ply areas spaced vertically along the height of the device, with suspending means on the carrying device for enabling hanging of the device generally vertically for said storage and retrieval of the calculators, formed in the single sheet of material, a series of vertical lines of stitching, parallel and spaced apart in each three-ply area so as to define and separate a plurality of pockets along each said three-ply area, the pockets being formed between the center ply and the back ply of material, and with the calculators stored in at least some of the pockets.

21. The apparatus of claim 20, further including a top fold line forming a double-ply hem of material extending horizontally at the top of the carrying device, with at least one horizontal line of stitching securing the two plies together.

22. The apparatus of claim 20, further including, at each of left and right edges of the carrying device, a vertical fold line wherein all of the alternating three-ply and single-ply material areas are overlapped to form a vertical hem at the left and right edges, with a vertical line of stitching securing each folded vertical hem.

23. The apparatus of claim 20, wherein the flexible material comprises denim.

24. The apparatus of claim 20, further including a series of horizontal lines of stitching, one along a bottom line of each of said three-ply areas, and each horizontal line of stitching connecting at least the front ply and the center ply of material in said three-ply area.

* * * * *